US005188342A

United States Patent [19]

Ouellette et al.

[11] Patent Number: 5,188,342

[45] Date of Patent: Feb. 23, 1993

[54] PORTABLE SAFETY RAIL SYSTEM

[75] Inventors: Kevin D. Ouellette, Andover; John Rexroad, Lyme, both of Conn.

[73] Assignee: SINCO Incorporated, East Hampton, Conn.

[21] Appl. No.: 820,844

[22] Filed: Jan. 15, 1992

[51] Int. Cl.[5] ..... E04H 17/14

[52] U.S. Cl. ..... 256/65; 256/59; 256/1

[58] Field of Search ..... 256/65, 59, DIG. 6, 256/1

[56] References Cited

U.S. PATENT DOCUMENTS

| | | | |
|---|---|---|---|
| 3,776,521 | 12/1973 | Weinert | 256/59 X |
| 3,853,203 | 12/1974 | Werner et al. | 256/65 X |
| 4,003,553 | 1/1977 | Morris | 256/59 |
| 4,787,475 | 11/1988 | Arteau et al. | 256/65 X |

*Primary Examiner*—Andrew V. Kundrat

*Attorney, Agent, or Firm*—Chilton, Alix & Van Kirk

[57] ABSTRACT

A safety rail system of roof edge protection employing support base units which include shoes for an upright post and a cantilever counterweight connector. The base units also include a toeboard saddle. The system components incorporate a number of releasably threaded lock pins and inspection ports to facilitate assembly.

15 Claims, 8 Drawing Sheets

PORTABLE SAFETY RAIL SYSTEM

BACKGROUND OF THE INVENTION

This invention relates generally to portable handrails which are mounted on the edges of a roof to protect workers thereon. More particularly, the present invention relates generally to portable handrail systems which are supported in place by a cantilever-type counterweight system.

Portable handrail or guard rail systems have long been employed to protect workers on roofs or elevated structures. Conventional portable handrail systems are modular systems which are assembled on a given job site in accordance with the specific work constraints. Commonly such systems employ a base which supports an upright post. These post assemblies are spaced along the edge of the roof. Rails connect between the upright posts to form the handrail system. Counterbalance assemblies extended from some of the bases. A number of such assemblies employ a bent cantilever arm which extends inwardly from the roof edge. A heavy weight is positioned to overlay an end portion of the cantilever arm. The weight conventionally takes the form of a concrete block or a similar mass with a handle to facilitate transporting the weight.

One conventional portable guard rail system marketed to the construction industry employs a multiplicity of bases. Each base has two vertical sockets for receiving the lower end of an inverted U-shaped modular rail unit. The bases have a generally square shape with a closed end recessed receptacle at each vertex. Each receptacle is dimensioned to receive the ends of a toeboard. Pins are employed to secure the guard rail units and toeboards to the bases.

In order to protect construction personnel on high rise construction projects, a number of regulatory provisions now require temporary protective railing structures. For example, floor openings, open sided floors, platforms and runways above a pre-established elevation may require guarding by a railing and a toeboard. Conventionally, the railing structure requires a top rail positioned approximately 42 inches from the upper surface of the floor or platform, an intermediate rail positioned between the top rail and the floor and a toeboard positioned along the bottom portion of the guard rail adjacent the floor. Because the guard rail systems are necessarily temporary and require assembly and disassembly, a key design feature is to provide a guard rail system which implements the required structural integrity, while also allowing for relatively easy disassembly and assembly on the job site. In addition, the geometry of the platform or area to be guarded may vary dramatically from construction site to construction site. Various fixed structures may also impact on the configuration of a specific guard rail system. For roof applications, one or more sides of the roof may have a parapet which also requires a guard rail.

SUMMARY OF THE INVENTION

Briefly stated, the invention in a preferred form is a protective roof edge guard rail system which comprises a multiplicity of substantially identical bases and modular rail units and includes a counterweight assembly. Each of the bases includes a base plate and a pair of tubular shoes which are mounted to the base plate. The shoes define receiving sockets. One of the sockets is generally parallel to the plane of the base plate, while the other socket extends in an upright orientation which is slightly oblique to the first socket. A toeboard saddle comprises transversely spaced upright plates mounted to the base plate for receiving a toeboard. Releasable compression locks in the form of threaded pins are employed for locking the modular rail units to the bases and also for locking the counterweight assemblies. In addition, a releasable compression lock fitting is employed for the toeboard saddle.

The guard rail frames may connect in either a fixed height or multi-height framework configuration to provide a highly flexible roof edge protection system along the perimeter of an elevated work area. The bases are also configured with a parapet stop plate which may be adapted for use either with or without a roof parapet. In addition, the base includes inspection ports for the connecting sockets. A rubber pad is affixed at the underside of the base to prevent sliding.

The counterweight assembly preferably comprises a bent connecting tube having at least two compound bends which may allow the base to be fixed at a selected height above the counterweight mass. The horizontal rails of the roof guard frame include inspection ports which allow for inspection of the positions of the slidably received rails. In addition, an instruction tube is affixed to the handrail frames for use in storing safety instructions and directions for the assembly and disassembly of the handrail system.

An object of the invention is to provide a new and improved universal guard rail system for roof edge protection.

Another object of the invention is to provide a new and improved universal guard rail system which is adaptable for installation in connection with a wide range of roof configurations, sizes and applications.

A further object of the invention is to provide a new and improved modular guard rail system which may be efficiently assembled and disassembled and provides a high degree of structural integrity and safety protection.

A further object of the invention is to provide a means of installing materials under the system components without removing the system or reducing its operation.

Other objects and advantages of the invention will become apparent from the drawings and the specification.

DETAILED DESCRIPTION OF THE PREFERRED EMBODIMENT

Figure 1:
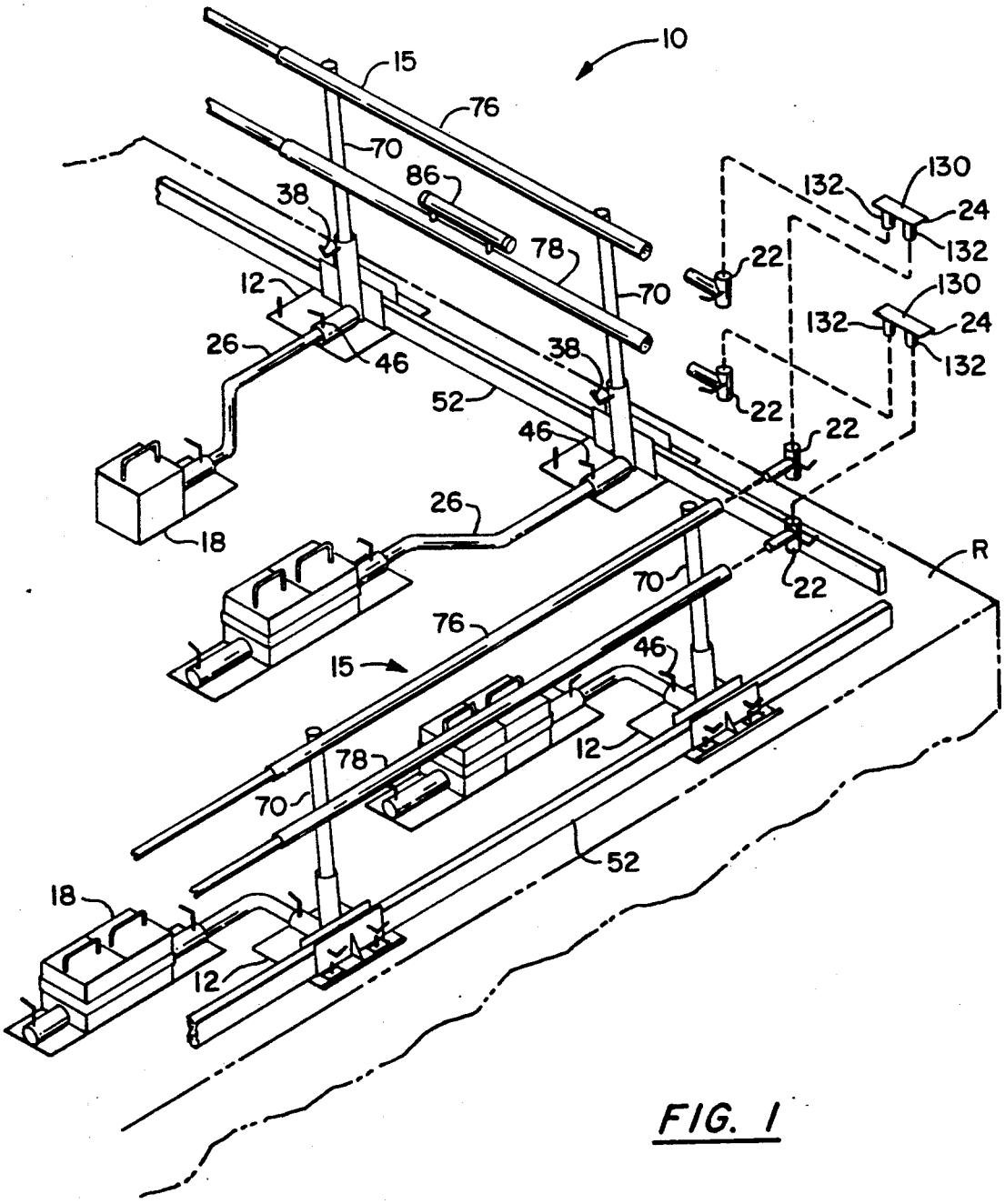
FIG. 1 is a fragmentary perspective view, partly in schematic, of a safety rail system in accordance with the invention, said system being illustrated in conjunction with the edge of a roof.

With reference to the drawings wherein like numerals represent like parts throughout the figures, a safety rail system, in accordance with the present invention, is generally designated by the numeral 10. The safety rail system is especially adaptable for use for protection at the edge of a roof R or elevated platform. The safety rail system is preferably employed as a temporary safety barrier to protect construction personnel on the roof R or elevated platform during construction or maintenance activities. The safety rail system is a modular system which is transported to the job site and assembled. The safety rail system 10 is installed adjacent to the edge of the roof and is configured for installation at multiple roof levels for a wide range of roof geometries and dimensions. When the job is completed, the safety rail system is disassembled and packaged and transported to storage or the next job site.

The safety rail system 10 is a modular system which is assembled for a given application from a relatively small number of basic component units which ordinarily comprise a multiplicity of substantially identical base assemblies 12, rail frame units 14 and 15, T-posts 16 (FIG. 10) and counterweight units 18. For a given application, the system also employs rails 20 (FIG. 10), T-couplers 22, tandem couplers 23 (FIG. 8), hinges 24, bent tubes 26 and straps 28 (FIG. 9). The foregoing components are selected for a given application, and the safety rail system is assembled on the roof R or elevated structure from the components to provide the integrated protective guard rail system.

Figure 2:
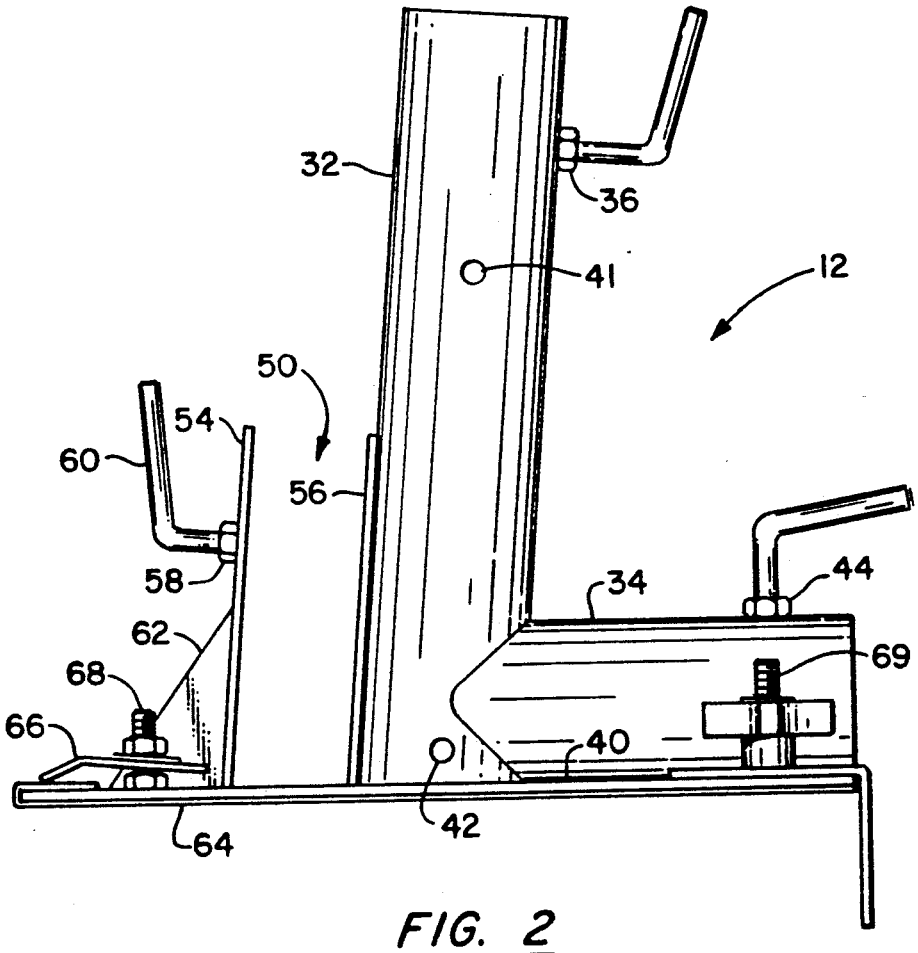
FIG. 2 is a side sectional view, portions removed, of a base assembly employed in the safety rail system of FIG. 1.
Figure 3:
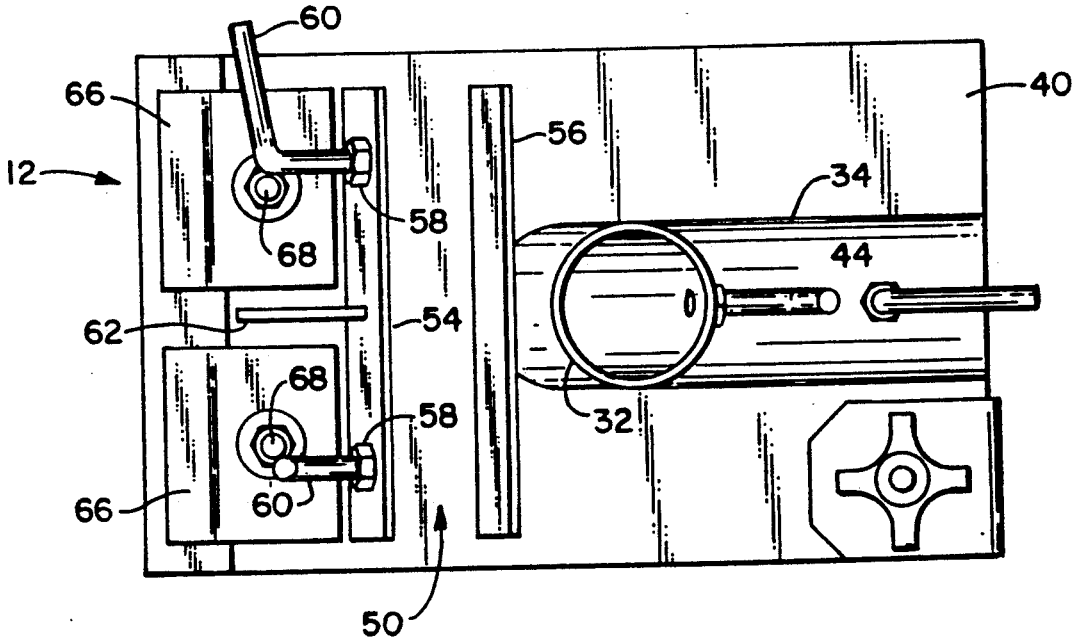
FIG. 3 is a top plan view, partly broken away, of the base assembly of FIG. 2.

With reference to FIGS. 2 and 3, the base includes a rectangular plate 40, which mounts a tubular upright shoe 32 and a tubular truncated connecting shoe 34 which is generally parallel to the plane of the base. Shoe 32 has an upper open end forming a socket which receives a post of a rail frame 14, 15 or a T-post 16. Shoe 32 is oriented at a slightly oblique angle, preferably on the order of five degrees, relative to the perpendicular to the base plate. A nut 36 is welded at an upper location of the shoe 32. An opening aligned with the nut allows for a threaded L-shaped lock pin 38 (not illustrated in FIGS. 2 and 3) threaded with the nut to be displaced into the socket. The lock pin 38 is torquable so that the end of the pin compresses against the received post to thereby secure, the post with the base. A pair of opposed inspection ports 41 provide a means for verifying the location of the received post. A weephole 42 may also be formed at the lower portion of the socket to provide for water drainage. A second nut 44 is welded at an opening at the top of the horizontal connecting shoe 34 for receiving a threaded lock pin 46. The lock pin 46 is torquable to compressably engage a cantilever connector arm 26 as will be further described below. The lock pins 38 and 46 are releasable for disassembly.

A toeboard saddle 50 is also affixed to the base for receiving a toeboard 52 (FIG. 1). The saddle 50 includes a pair of equidistantly spaced upright plates 54 and 56 which closely receive the toeboard or abutting ends of toeboard sections. The plates 54 and 56 may have the same slightly oblique angle as shoe 32. A pair of nuts 58 are welded to the outer plate 54 at aligned openings through the outer plate. A lock pin 60 is threaded to each of the nuts 58 for releasably securing a toeboard or the ends of toeboard sections. A gusset 62 may be welded between the base plate and the outer plate to reinforce the saddle. A rubber pad 64 is attached at the underside of the base plate 40. The pad 64 enhances the resistance of the base assembly to sliding.

Figure 4:
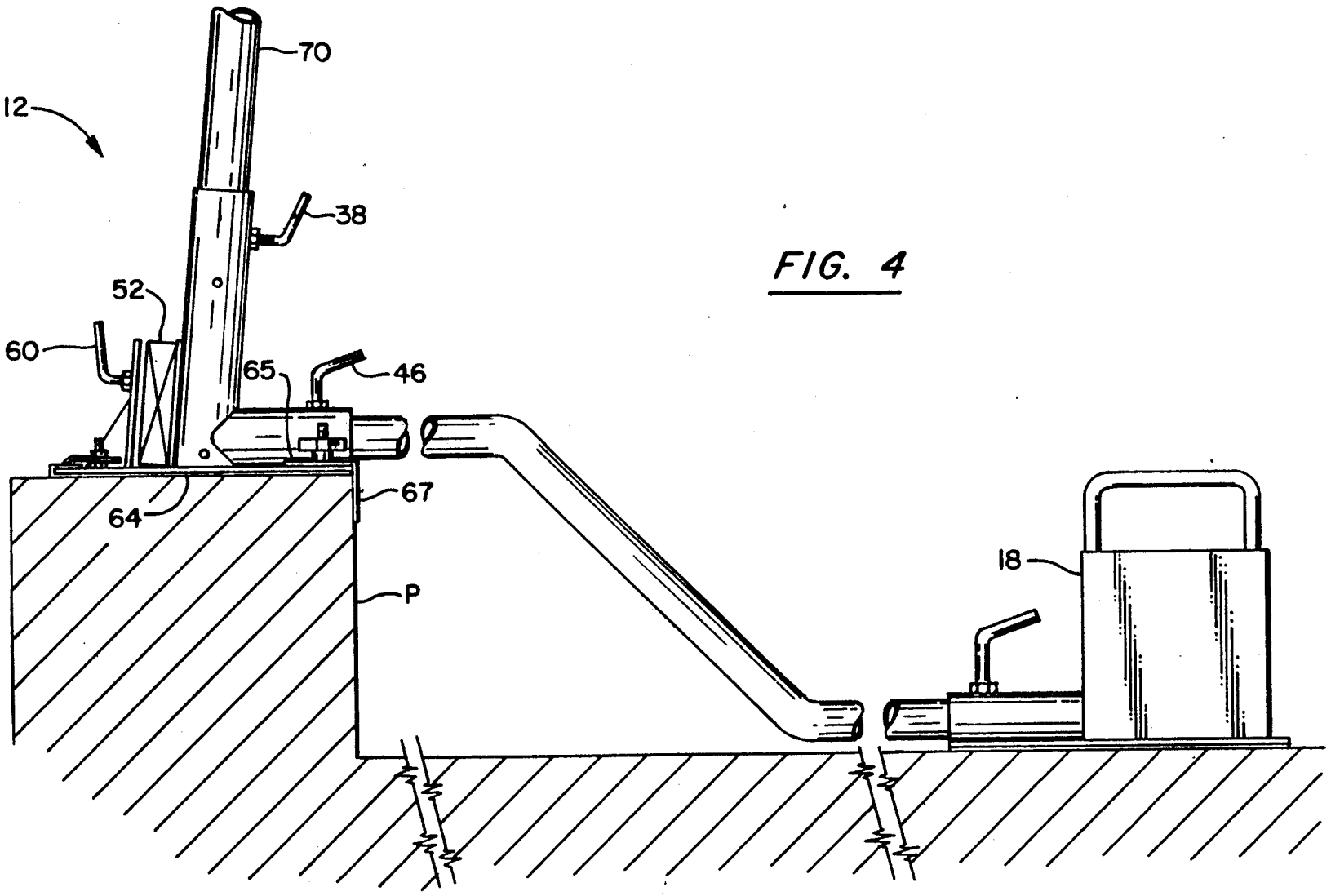
FIG. 4 is a side elevational view, partly broken away, of a portion of the safety rail system of FIG. 4, said system being illustrated in conjunction with a roof having a parapet.
Figure 6:
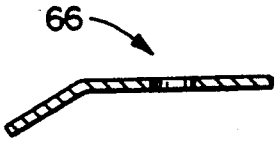
FIG. 6 is an enlarged sectional side view of a clamp for the base assembly of FIG. 4.

With reference to FIGS. 4 and 6, base assembly 12 is affixed with a rubber pad 64 which extends forwardly and is wrapped around a frontal edge of the base plate 40 to overlie the top of the plate. The pad is secured by a pair of angled clamp plates 66 (FIG. 6). The clamp plates are secured to the plate by bolts 68 (FIG. 3). The continuous wrapping of the pad 64 makes the pad less susceptible to stripping from the base plate.

Figure 5:
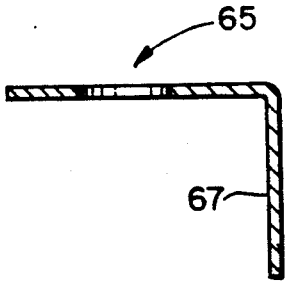
FIG. 5 is an enlarged side sectional view of a parapet flange for the base assembly of FIG. 4.

Base assembly 12 is also configured for a parapet application as illustrated in FIG. 4. A parapet stop 65 having a perpendicular retaining flange (FIG. 5) is also bolted at the top of the rear edge of the base plate. The parapet stop 65 is secured to the base plate by a removable nut assembly 69. The parapet stop flange 67 may be turned downward as illustrated in FIG. 4 and the base assembly positioned against the roof parapet P so as to form a retainer stop with the inner top edge of the parapet. For a flat roof surface, the parapet flange is reversed and the flange portion is turned upward (not illustrated) so that essentially a flat bottom supporting surface is obtained for the base assembly.

Each rail frame 15 includes a pair of parallel support posts 70. Tubular upper and lower cross rails 76 and 78 are welded to the posts in generally parallel disposition. With additional reference to FIG. 10, L-shaped lock pins 80 are threaded to nuts welded to the underside and top of rails 76 and 78, respectively, for releasably locking against connector rails 20 or other components which are closely slidably received in the ends of the rails. The cross rails 76, 78 also include opposing inspection ports 84 so that the received connecting rails may be properly positioned and the positions verified. I addition for rail frame 15, a storage tube 86 is mounted to the top of intermediate rail 78 to provide a convenient container for instructions for the safety rail system.

With additional reference to FIG. 9, the counterweight unit 18 comprises a base plate 90 with rubber pad attached. A tubular connector socket 92, which closely receives one end of the cantilever connector arm 26, is mounted to open at one end portion of the plate. A lock pin 94 is threaded to a nut 96 mounted adjacent the open end of the socket for locking the cantilever ar in position. A box-like container 98 extends upwardly from the plate 90. The container 98 is filled with poured concrete or other solid forming high density weighted material. An inverted U-shaped handle 97 at the top of the counterweight facilitates portability of the counterweight unit. The back end 99 of the container 98 is planar. Thus, the counterweight units are configured so that two units may be positioned in a back-to-back relationship as illustrated in FIG. 9. The counterweight units may be strapped together by means of a strap 28 encircling the containers 98 so that the mass of the counterweight may be enhanced as required. Weights may also be used a single units. It should be appreciated that the cantilever arm, which has a pair of oblique compound bends, allows for the counterweight assembly to be efficiently anchored with the support base, even from an elevated base assembly location as illustrated in FIG. 4.

Figure 10:
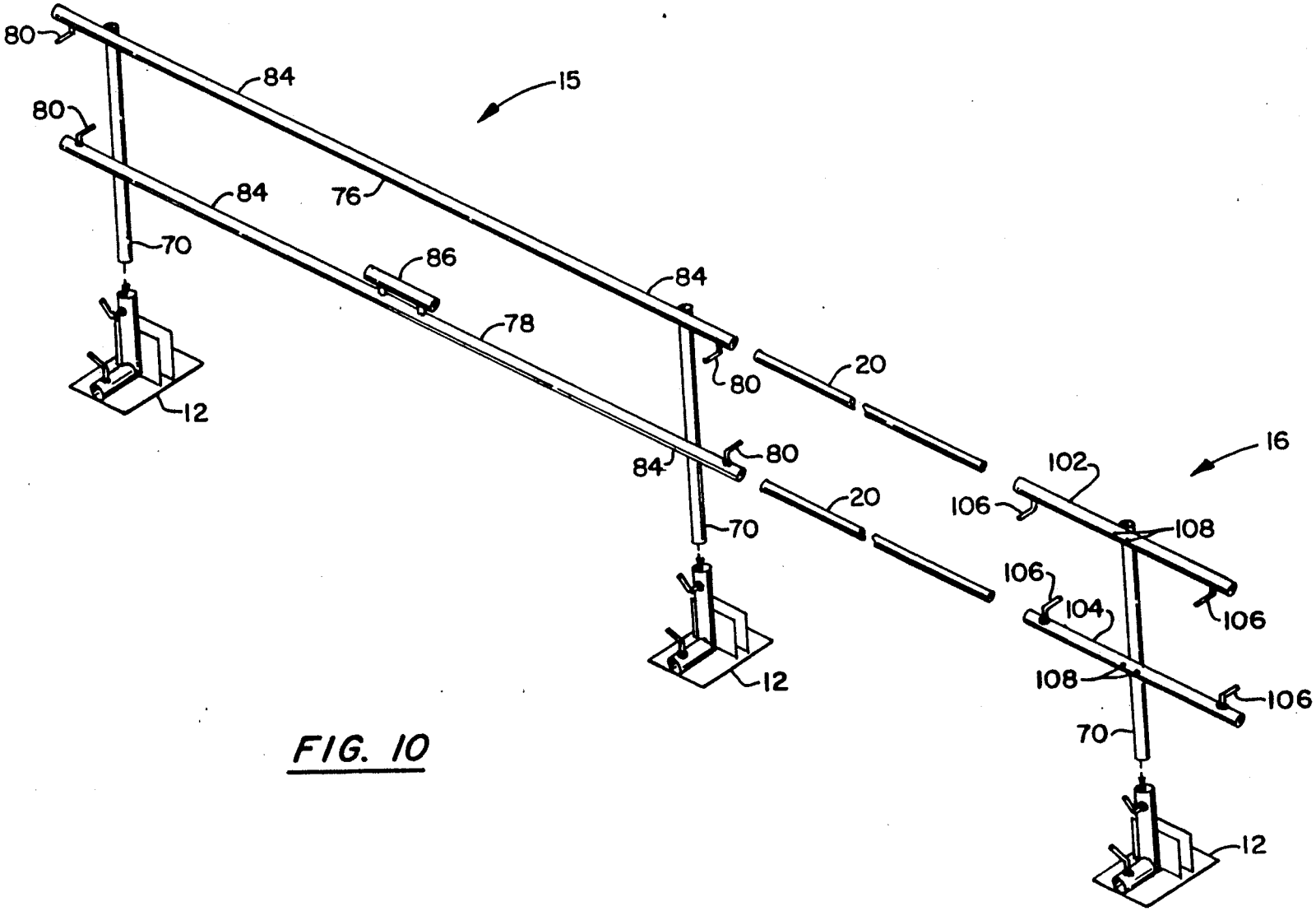
FIG. 10 is an exploded fragmentary perspective view, partly broken away, of an additional embodiment of the safety rail system in accordance with the present invention.
Figure 11:
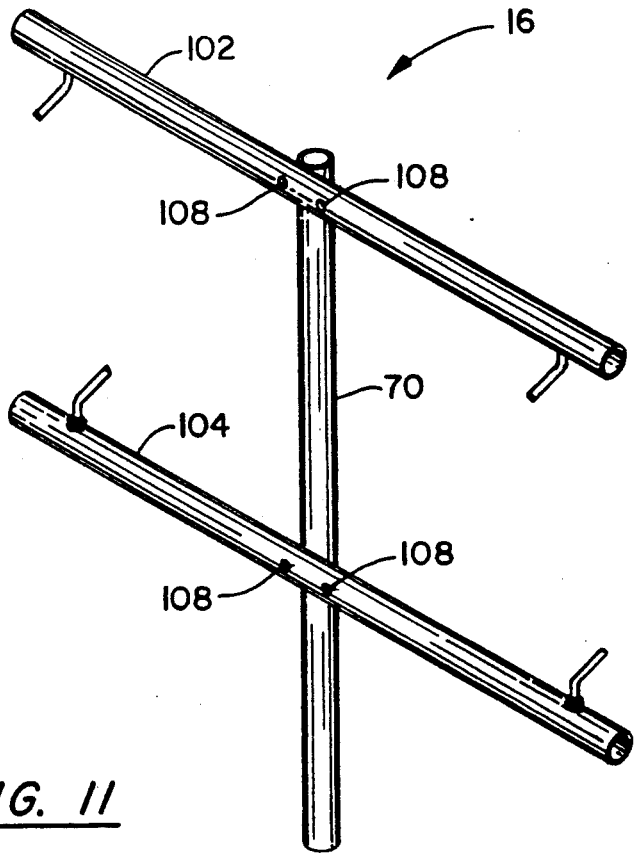
FIG. 11 is an enlarged frontal perspective view, of a component of the safety rail system of FIG. 10.

With reference to FIGS. 10 and 11, the T-post 16 comprises a support post 70 which mounts a pair of tubular upper and intermediate cross members 102 and 104. The opposed open ends of the tubular members 102, 104 function as sockets for receiving rails 20 or other connecting components. A lock pin 106 is located adjacent each open end and is threaded to the cross members for tightening against a received rail 20. Inspection ports 108 are also drilled into the sides of the cross members so that the position of the received rails may be readily ascertained.

Figure 7:
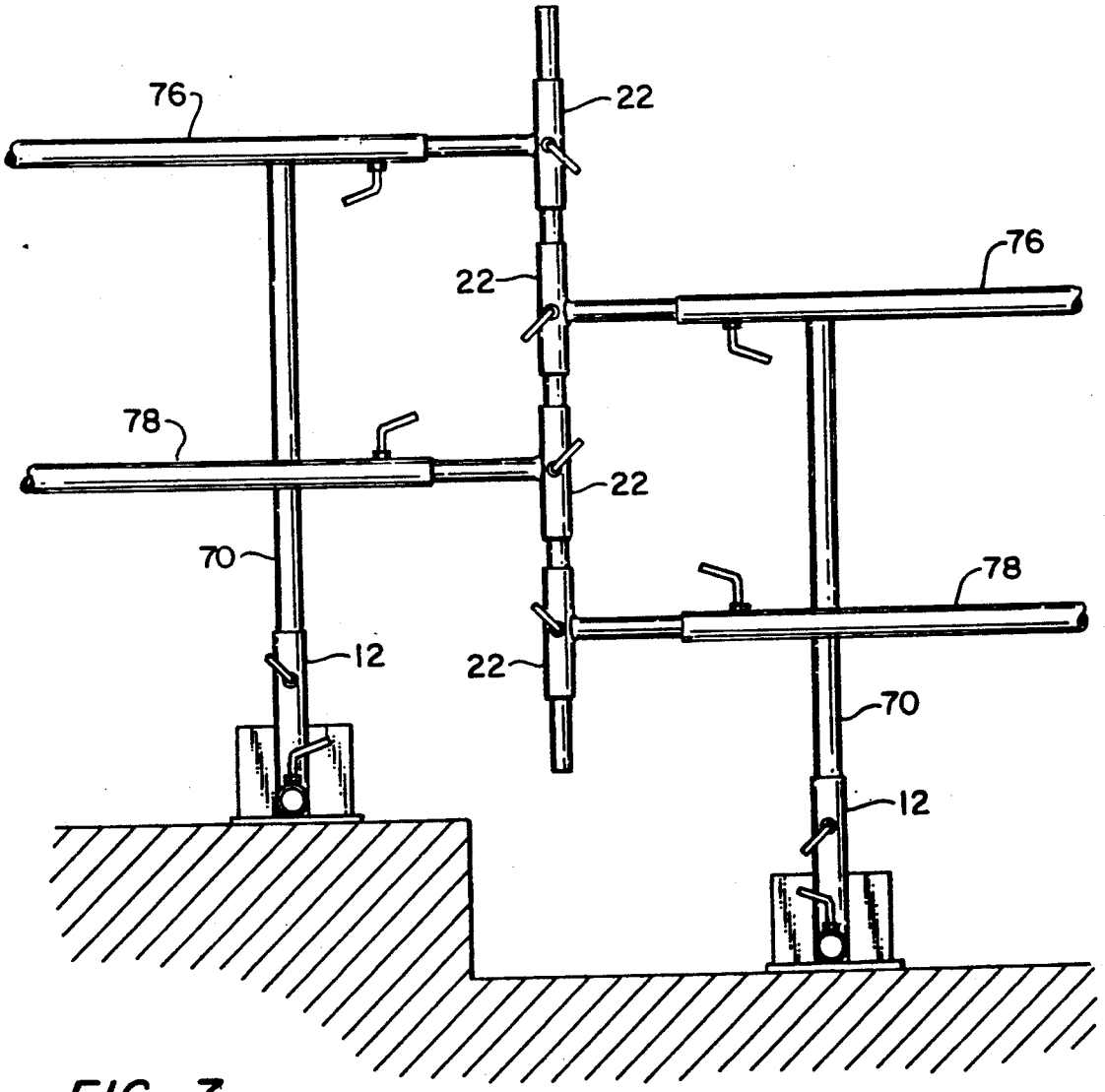
FIG. 7 is a side elevational view, partly in schematic and partly in phantom, illustrating a multi-elevational configuration of the safety rail system of FIG. 1.
Figure 12:
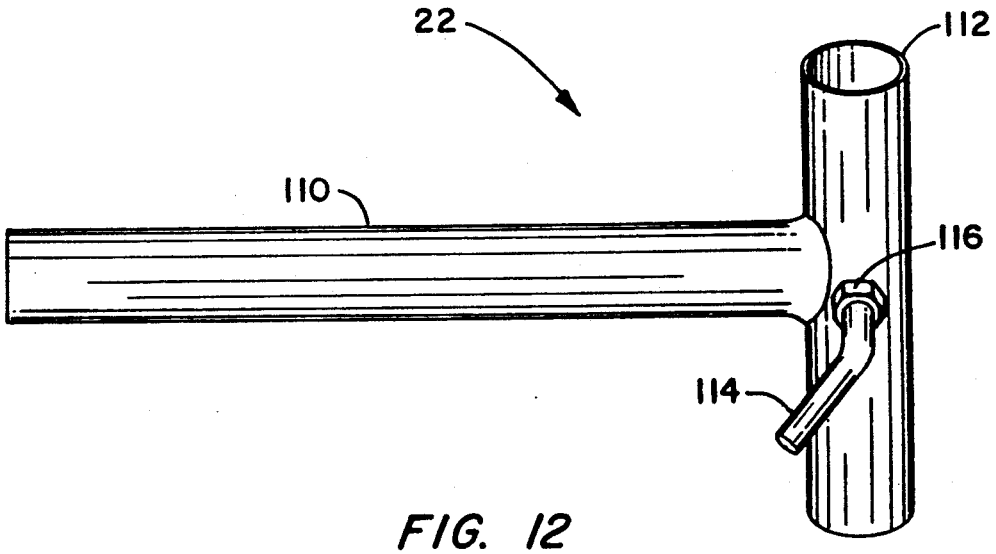
FIG. 12 is an enlarged perspective view, of a connector element employed in the safety rail system of FIG. 1.

With reference to FIG. 12, T-couplers 22 are also employed to enhance the versatility of the safety rail system. The T-couplers 22 include a pair of coupler tubes 110 and 112 which are welded at right angles to each other. Tube 110 is crimped at one end and welded to the side of tube 112 at a medial location. A threaded lock pin 114 is also threaded to a nut 116 welded at an axial central opening of the coupler tube 112 for compressably engaging a received rail. The T-couplers 26 are employed for rail configurations wherein the roof may have slightly different levels. For example, as illustrated in FIG. 7, the T-couplers 22 may be connected at adjacent cross rail ends to vertically receive and mount a transition vertical rail 20 to provide a continuous rail despite the differences in the height of adjacent frame units 14. T-couplers 22 also allow for right angle corners to provide for a continuous rail.

Hinges 24 in the form of a plate 130 mounting a pair of studs 132 may also be employed to connect With the T-couplers 22 locked at the ends of opposing cross rails to provide a continuous adjustable corner rail segment such as illustrated in FIG. 1. The studs are inserted into the top of the vertically oriented tubes 112 and releasably locked in position by lock pins 114. The hinges 24 also allow for corners which may be obtuse as opposed to right angles so as to provide a continuous railing.

Figure 8:
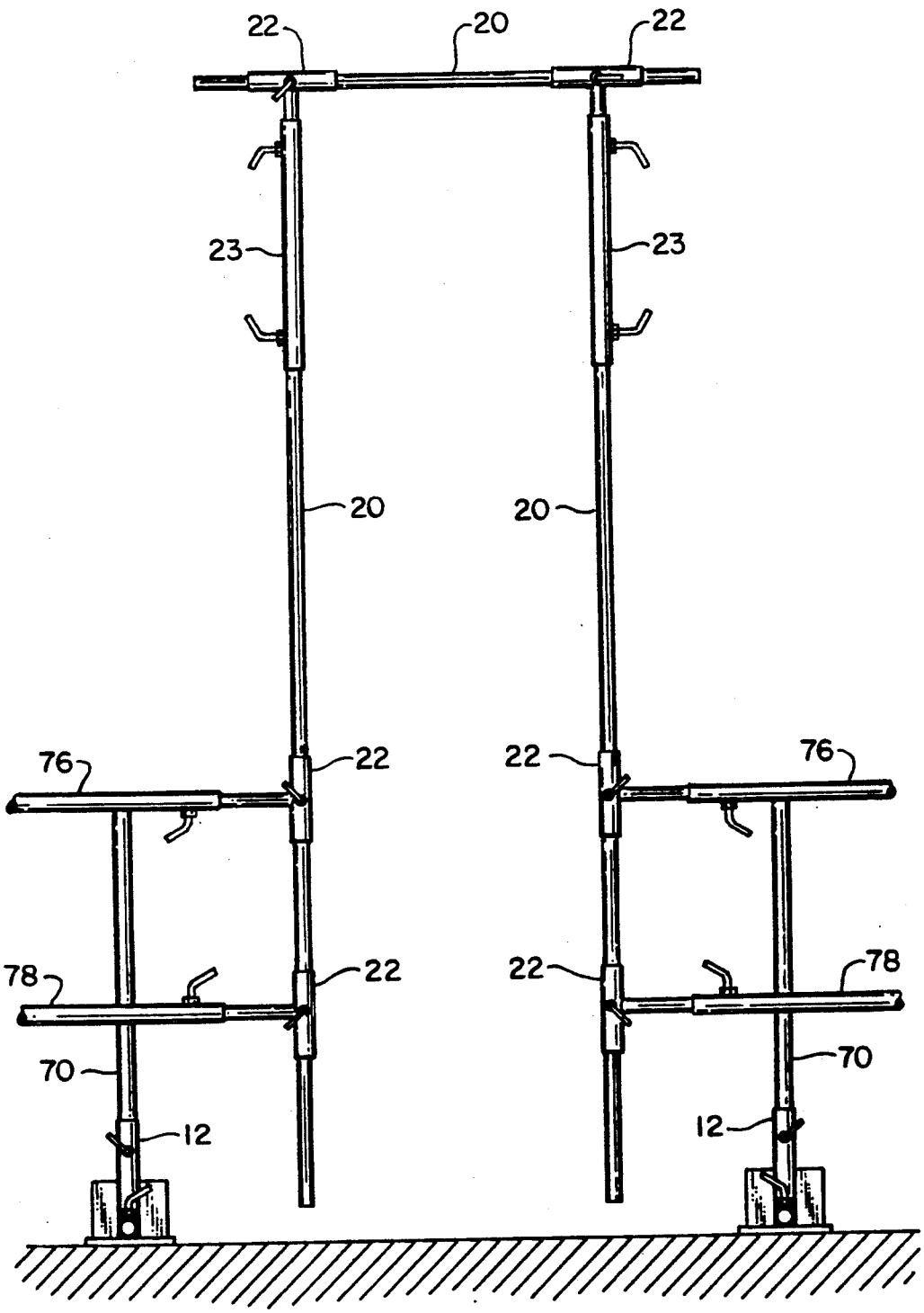
FIG. 8 is a fragmentary side elevational view, partly broken away and party in phantom, illustrating an entranceway configuration of the safety rail system of FIG. 1.
Figure 9:
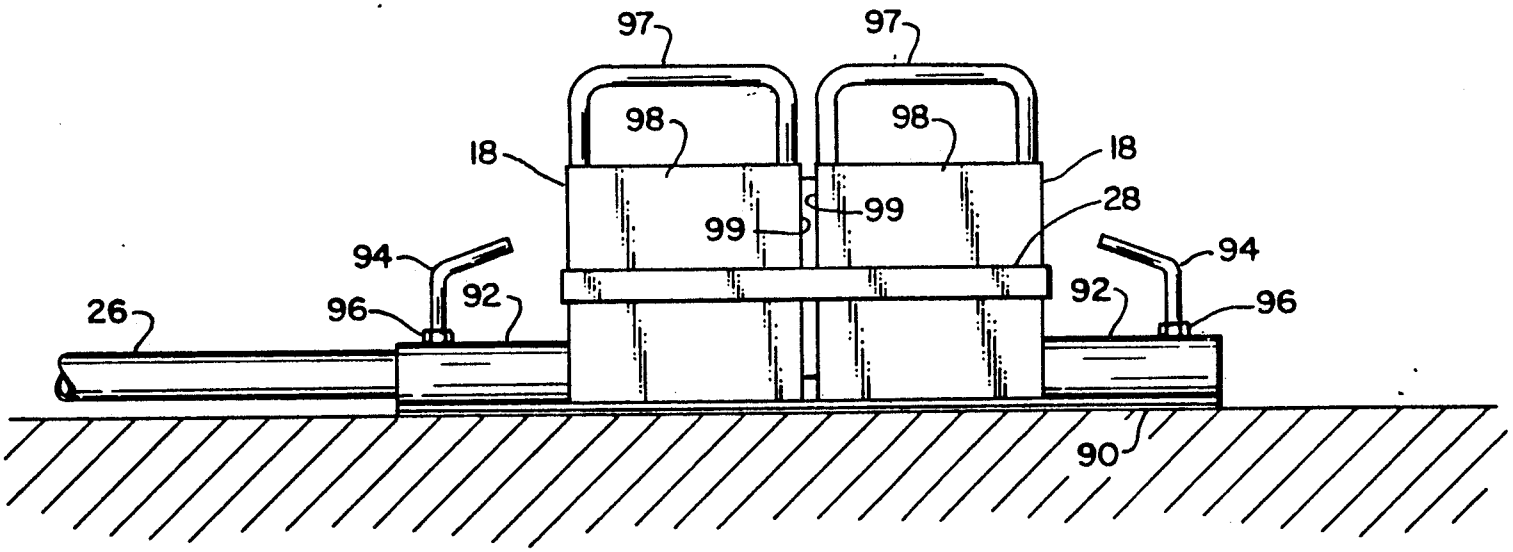
FIG. 9 is an enlarged side elevational view of a counterweight system for the safety rail system of FIG. 1.

The safety rail system may also be configured so as to allow for an entranceway, if required for a given application, such as illustrated in FIG. 8. Tandem couplers 23 are employed for vertically connecting a vertical rail 20 and a tube 110 of a T-coupler 22. Tandem couplers 23 are tubular members having opposed open ends which are dimensioned to closely receive a rail 20 or a tube 110. The tandem couplers include axially spaced lock pins 140 which are threaded to the tubular members to provide for axial coupling between rails 20 and/or T-couplers 22.

It will be appreciated that the safety rail system 10 may be transformed into a multiplicity of configurations and geometric shapes including multi-elevational levels at the work site with a fairly small number of basic components. In addition, the counterweight support for the system may also be configured to accommodate a wide range of constraints which are presented at the work site, as illustrated in FIGS. 1 and 4. The safety rail system may be transformed into a continuous rail enclosure even for multiple elevation roof structures and for structures in which there are obtuse corners as well as right angle corners.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A base support for a safety rail system for roof edge protection or the like comprising:

base plate means;

first shoe means mounted to said base plate means, said first shoe means defining a first receiving socket having a central axis generally parallel to said plate means;

first locking means for compressively locking a member received in said first socket with said first shoe means;

second shoe means mounted to said base plate means and oriented in a generally upright disposition at an oblique angle relative to said first shoe means axis, said second shoe means defining a second receiving socket;

second locking means for compressively locking a member received in said second socket with said second shoe means;

saddle means comprising a pair of generally parallel transversely spaced plates for receiving a toeboard; and third locking means for compressively locking a toeboard to said saddle means.

2. The base support of claim 1 wherein at least one said locking means comprises a threadably mounted lock pin and an integral handle for applying a torque to said lock pin.

3. The base support of claim 1 wherein said first shoe means further defines at least one inspection port in said first socket.

4. The base support of claim 1 wherein one of said saddle means plates connects to said first shoe means.

5. The base support of claim 1 wherein said base plate means comprises a plate having a bottom surface and a top surface and further comprising a rubber sheet affixed to said bottom surface.

6. The base support of claim 5 wherein said rubber sheet extends to cover a portion of said top surface.

7. The base support of claim 6 further comprising an angled clamp plate engaging said rubber sheet for securing said sheet against said to surface.

8. The base support of claim 1 further comprising parapet means mounted to said base plate means, said parapet means comprising a member having a generally perpendicular flange-like portion which is projectable from said plate means in a direction generally opposite said first socket means.

9. The base support of claim 1 wherein said saddle means laterally extends at opposing positions of said first shoe means.

10. The base support of claim 1 and further comprising a toeboard received in said saddle means, an upright post received in said first socket, and a connector received in said second socket and extending generally transversely therefrom.

11. A rail frame for a safety rail system for roof edge protection or the like comprising:

a pair of generally parallel support posts;

a pair of generally parallel rails connecting said posts and extending generally orthogonally thereto, said rails each forming a pair of opposed receiving sockets, each said rail further defining at least one inspection port opening into each said socket;

locking means comprising a pin threaded to said rail proximate each end thereof, each said pin being variably projectable into a corresponding socket; and an open-ended tube mounted to one of said rails in generally parallel relation thereto.

12. The rail frame of claim 11 wherein said locking means further comprises a nut welded to a said rail and said pin is threaded to said nut.

13. The rail frame of claim 12 further comprising a handle integrally extending from said pin at an angle thereto.

14. The rail frame of claim 11 wherein said tube is generally symmetrically located relative to said support posts.

15. The rail frame of claim 11 further comprising a T-shaped tubular coupler comprising a leg portion received in a socket and locked thereto by said locking means, said coupler comprising a tubular section extending generally orthogonally to the said rail, and locking means mounted to said section and variably projectable therein.

* * * * *